US006955518B1

(12) United States Patent
Hagel

(10) Patent No.: US 6,955,518 B1
(45) Date of Patent: Oct. 18, 2005

(54) TRANSFER DEVICE

(76) Inventor: Hermann Hagel, Sauterleutestrasse 21, D-88250 Weingarten (DE)

( * ) Notice: Subject to any disclaimer, the term of this patent is extended or adjusted under 35 U.S.C. 154(b) by 0 days.

(21) Appl. No.: 10/381,645

(22) PCT Filed: Sep. 29, 2000

(86) PCT No.: PCT/EP00/09595

§ 371 (c)(1),
(2), (4) Date: Oct. 9, 2003

(87) PCT Pub. No.: WO02/26415

PCT Pub. Date: Apr. 4, 2002

(51) Int. Cl.[7] ..... B25J 5/02
(52) U.S. Cl. ..... 414/591; 74/490.04; 901/21
(58) Field of Search ..... 414/591; 198/468.4, 198/750.12, 468.01, 468.2, 750.1; 74/490.04, 74/490.03; 901/21, 16, 23

(56) References Cited

U.S. PATENT DOCUMENTS 4,650,063 A 3/1987 Zierpka
6,151,981 A * 11/2000 Costa ..... 74/490.03

FOREIGN PATENT DOCUMENTS

| | | | |
|---|---|---|---|
| DE | 25 34 820 | A1 | 2/1977 |
| DE | 43 09 642 | A1 | 9/1994 |
| DE | 44 08 447 | A1 | 9/1995 |
| DE | 195 06 520 | A1 | 8/1996 |
| DE | 19515994 | * | 11/1996 |
| EP | 0 930 110 | B1 | 7/1999 |
| WO | WO 96/34817 | A1 | 11/1996 |

* cited by examiner

*Primary Examiner*—Donald W. Underwood
(74) *Attorney, Agent, or Firm*—Wolf, Greenfield & Sacks, P.C.

(57) ABSTRACT

The invention relates to a transfer device including a guiding mechanism, a slide which can move on the guiding mechanism, a plunger which can move on the slide, and first, second and third drive wheel sections which are provided on the slide in such a way that they can be rotated together, but not in relation to each other. The first and second drive wheel sections are respectively engaged with the drive wheel sections by means of traction mechanisms on opposite sides, and can be driven by a motor which is fixed in relation to the slide. The third drive wheel section is connected to the plunger in a driving manner.

5 Claims, 4 Drawing Sheets

TRANSFER DEVICE

TECHNICAL FIELD

The invention relates to a transfer device.

It is particularly in fabrication plants, especially when involved in the production of sheet metal parts, that a movement of parts in two different directions is regularly required, typically perpendicular to each other. For example, sheet metal blanks in sheet metal presses and punchers need to be picked from a stack of blanks vertically before being subsequently fed to the press horizontally. In the press the blank is usually lowered in place vertically. The feeder or generally speaking the transfer device then returns to the stack of blanks in a reversal of the movements described.

Removing the fabricated parts is implemented correspondingly by suitable transfer devices. In particular, the device lifts the finished part on the press, picks it up and transfers it horizontally to the next workstation or a means for intermediate storage where it is deposited. Finally, a typical application of such transfer devices is in a multiple press in which a plurality of workpieces each located in a workstation of the multiple press is gripped by a lateral movement of gripper rails and is thereafter lifted by a vertical movement. A forwarder usually provided separately forwards the parts in the machining direction. In this case too, the transfer device is required to achieve two movements in different directions to move the so-called gripper rails.

PRIOR ART

Known from DE 34 01 703 A1 is a forwarding device for the stepwise transport especially in presses, comprising two gripper rails fixedly coupled to a forwarding slide in the forwarding direction and permitting transverse movement. A forwarder drive permits joint movement of the gripper rails in the forwarding direction. Transversely to the forwarding direction, the gripper rails are driven opposingly by means of a transverse drive. By a suitable guiding means, for example a cogged belt, the opposing transverse movement is achievable by a single drive. However, this drive needs to be moved with the forwarder slide so that the drive for the forwarder slide needs to be dimensioned to a comparative size. Furthermore, those cables leading to the transverse drive must always be on the move in operation which poses a risk to them becoming damaged or makes complicated means of protection necessary.

DE 43 09 642 A1 describes a transfer device in which the gripper means are driven by separate motors in the axes. The motion is translated by cogged belts in constant engagement. In this case too, the drive motors need to be co-moved the motion at least in part which again poses the problems as described above.

Known from DE 25 34 820 A1 is a transfer device in which a slide is driven by a fixed motor via an endless belt fixedly attached to the slide. The up and down movement of a plunger in the slide is provided by a likewise fixed reciprocating drive guided by a further belt via the slide and more particularly via the plunger thereof.

SUMMARY OF THE INVENTION

The invention is based on the object of providing a transfer device of simple design which is simple to operate, in which two movements in different directions are achievable each independent of the other by fixed and compactly dimensioned motors.

This object is achieved by the transfer device as it reads from claim 1.

The transfer device in accordance with the invention comprises a guiding means on which a slide is movable. Usually the guiding means for moving the slide is configured to be fixed. It is just as conceivable, however, that the guiding means is movable relative to a fixed frame to achieve by means of the moving guide means a movement in a third direction, in addition to the two directions achieved by means of the transfer device in accordance with the invention. A plunger is movable on the slide in a direction which differs from the direction of movement of the slide. In this case the term "plunger" indicates that it is usually moved vertically relative to the slide whilst the slide is usually moved horizontally. It is, however, to be noted that using these terms is intended in no way to restrict application of the transfer device in accordance with the invention to such a case. For instance, the device could be configured so that the slide is shifted horizontally and the plunger substantially perpendicularly to the shift of the slide, but likewise horizontal. The advantages afforded by the device also materialize when configuring the transfer device such that two horizontal movements are achieved each independent of the other. Furthermore, the so-called slide could be vertically movable and the plunger in any direction horizontally.

The transfer device in accordance with the invention now makes it possible to achieve two movements by a particularly simple and reliable means in that two motors are provided fixed at least relative to the slide. The two motors drive a first and second drive wheel section rotatable together in common with a third drive wheel section, but provided relative to each other non-rotatablely on the slide. Preferably the drive wheel sections are fixedly provided on a common shaft or rotatable together on a spindle. In other words, the three drive wheel sections are not movable relative to each other. In accordance with the invention, it is conceivable to combine all three drive wheel sections in a single, comparatively wide drive wheel. However, it is preferred, as subsequently described, that the three drive wheel sections are provided as separate drive wheels. With the first and second drive wheel section traction means, more particularly a belt or a chain, engage at opposing sides. More particularly, the first or second drive wheel section is driven at its upper side whilst the other drive wheel section is driven at its lower side. This permits a joint rotation of all drive wheels by operating the two drive motors opposingly. It is basically conceivable that both traction means engage each drive wheel section at opposite sides and are maintained engaged by suitable ways and means. It is preferred, however, that the traction means are wrapped at least sectionwise around the respective drive wheel section. For example, suitable guide rollers may be provided upstream and downstream of each drive wheel for wrapping the traction means, for example a cogged belt, half the circumference of a drive wheel section. The other traction means is wrapped correspondingly about part of the drive wheel section on the opposite side. As regards the traction means, it is furthermore to be noted that for this purpose flexible means, such as cogged belts or chains are suitable. It is, however, just as conceivable to shift a gear rack by a suitable drive which engages each drive wheel section on a suitable side.

Due to the opposing engagement of each traction means via the first and second drive wheel, respectively, the first motor needs to be driven especially in the direction opposite to that of the second motor to achieve rotation of the shaft in the slide by means of the engagement between each traction means and the drive wheel. In this arrangement it is basically conceivable to provide a single motor with two drive wheels driven by a suitable reversible gear for motion in the same direction and in opposite directions as required. Providing such an arrangement achieves the drive movements with the transfer device in accordance with the invention by a single motor. Such an arrangement is likewise in keeping with the basic idea of the invention even when the following description makes reference to two separate motors.

As detailed further on, it is the common rotation described above of the first and second drive wheel sections that also drives the third drive wheel section drivingly connected to the plunger so that rotation of the third drive wheel permits movement of the plunger relative to the slide. For example, the drive wheel is preferably configured as a gearwheel engaging a gear rack or cogged belt fixed in or on the plunger. It is in this way as described that in accordance with the invention movement of the plunger relative to the slide is achieved by suitably operating the two motors.

When the slide is to now be moved, the two drive motors are not driven in opposite directions, but instead such that the two traction means guided opposingly around the two drive wheels now have traction in the same direction on the two drive wheels. Since the traction means, as mentioned, are guided on opposite sides via the drive wheels, the one traction means has so-to-speak traction "upwards" at the corresponding drive wheel whilst the other traction means has traction "downwards" at the drive wheel in the same direction. This does not result in rotation of the common shaft, however, instead, the slide is driven by the cooperation of the two drive motors.

The aspect as last described is a particular advantage of the transfer device in accordance with the invention apart from the fact that the two motors can be configured to be fixed. Namely both motors cooperate in achieving all movements. As last described, traction is provided by both motors via the corresponding traction means at each drive wheel and thus in all on the slide to shift it jointly. Furthermore, as described above, rotation of the third drive wheel and thus the movements of the plunger relative to the slide is achieved by the cooperation of the two motors. The motors can be rendered particularly compact therefore since no single motor of the two is provided "alone" for moving the slide or plunger. Furthermore, as mentioned, both motors may be attached fixed at least relative to the slide so that none of the two motors needs to be designed to move the other motor together with the element actually needing to be moved, in other words, the slide. Furthermore, the transfer device in accordance with the invention requires no cables needing to be connected to a moved motor. Thus, this ensures no risk of damage with the elimination of complicated means of protecting the cables subject to constant movement and in particular bending.

Preferred further embodiments of the transfer device in accordance with the invention read from the further claims.

As mentioned above, the drive wheel sections are preferably provided as separate drive wheels which has the advantage that each traction means engages the respective drive wheel at locations spaced from each other and can thus not come into conflict with each other.

For moving the cited components and more particularly for an especially precise and accurate control of the movements, a contour control system for the two drive motors has proven to be of advantage. Accordingly, in the transfer device in accordance with the invention a means for contour control of the motor is assigned to each of the two drive motors. The person skilled in the art knows that contour control of the respective motor defines the precise point in time at which the means driven by the motor is to assume a particular location by means of a precise assignment on a very fine matrix. This system permits controlling the movements of the two motors with so little difference in effect that no unwanted movements need to be feared. In other words, in the transfer device in accordance with the invention it is to be noted that both motors are required to provide traction by simultaneous movements precisely adapted for driving the slide. Should the movement of one of the two motors differ from that of the other, this would result in at least a slight rotation of the spindle mounting all the drive wheels, as explained above. Such a rotation would trigger at least a slight movement of the plunger relative to the slide which is undesirable and more particularly hazardous. This is prevented by the contour control system as preferably provided and the precise control of movements of the two drive motors as achieved can prevent this and ensure a reliable operation of the transfer device in accordance with the invention.

As mentioned above, the use of cogged belts as the traction means has proven to be particularly of advantage. It must, however, be noted that, of course, chains or any other comparable means are just as conceivable. Cogged belts can be designed, however, for the purpose in accordance with the invention so that their stretch under loading remains within acceptable limits.

In the transfer device in accordance with the invention the traction means, i.e. more particularly the cogged belts, need to be guided over comparatively long distances, namely over the distance traveled by the slide and back to the fixed location of the motors. To advantageously prevent the traction means tending to oscillate over relatively long free lengths between the guide roller locations, it is preferred in accordance with the invention to provide a guiding means for the tension means. This guiding means extends parallel to the direction of movement of the slide to a certain extent laterally from each guiding means and guides at least one specific location of the traction means. Preferably the guiding means is configured so that a clincher is provided in the endless traction means, i.e. preferably in the endless cogged belt. One result of this is that the clincher, which is relatively bulky as compared to the belt and tends to oscillate, cannot move in a direction perpendicular to the guiding means. It is in this way that oscillations to the risk of detrimenting the sequence of movements are prevented. It is to be noted that, of course, it is just as conceivable to provide a guiding means in which an edge section of a traction means is guided over the full length of free sections.

For the driven connection between the third drive wheel and the plunger, a variety of alternatives is conceivable. In the scope of the invention it has proven to be particularly of advantage to configure the third drive wheel as a drive wheel cooperating with a gear rack fixedly connected to the plunger or with a cogged belt attached at one end fixedly to the plunger and guided around the third drive wheel.

BRIEF DESCRIPTION OF THE DRAWINGS

Example embodiments of the invention will now be detailed with reference to the drawings in which.

DETAILED DESCRIPTION OF PREFERRED EMBODIMENTS OF THE INVENTION

Figure 1:
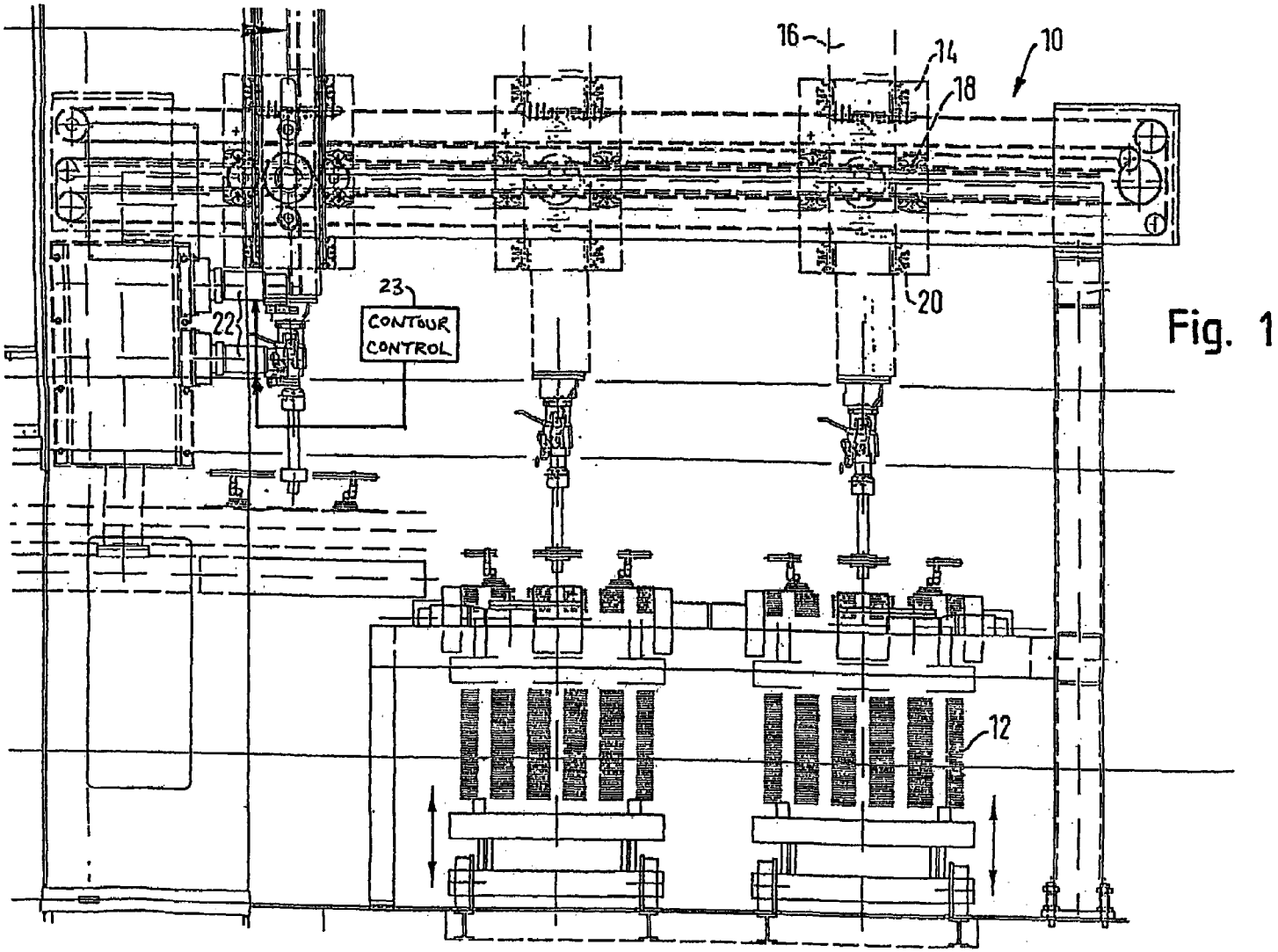
FIG. 1 is a side view of the transfer device in accordance with the invention.

Referring now to FIG. 1, there is illustrated an embodiment of the transfer device 10 in accordance with the invention configured as a blank feeding device or so-called feeder. In more detail, the transfer device 10 picks single blanks from a stack 12 thereof firstly vertical before then shifting them horizontally to the left, as shown in FIG. 1, for placement in the insertion zone, for example, of a hydraulic press by a movement in the vertical direction. Gripping each blank is substantially achieved by a suction means. Following placement of a blank in the insertion zone of a press or punch, the gripper with the suction means is lifted at least in part, by a horizontal movement, as shown in FIG. 1 to the right, returned above the stack of blanks and the next blank is gripped by the gripper by being lowered in the vertical direction.

These movements are achieved in the transfer device 10 in accordance with the invention by, for one thing, a slide (carriage) 14 shiftable in the horizontal direction and, for another, by a plunger (slider) 16 guided in the slide 14 in the vertical direction, with the gripper being mounted at the bottom end of plunger 16. The slide 14 is moved horizontally over several rollers 18 which may be configured in a tapered form and may run in a guide rail shaped complementary thereto. Similar rollers are identified by the reference number 20 for the movement of the plunger 16 in the slide 14. Evident furthermore in FIG. 1 are the two drive motors 22 driving via suitable gear units a drive wheel, moving a belt in each case which is guided via drive wheels as described in more detail later on as provided in the slide. As regards FIG. 1 it is furthermore to be noted that three different positions of the slide 14 and of the means provided therein are shown. It will be understood, however, that only a single such slide 14 is provided at the section of the transfer device 10 as shown in FIG. 1. In conclusion, the complete guiding means of the drive belts as detailed in the following is shown. The belts run substantially in the form of a 90° "U" open to the left. On three sides, namely as shown in FIG. 1, at the top, bottom and on the right each of the two belts is guided so-to-speak at the outer side one after the other. At the bottom corner on the left the two belts are guided at different levels to achieve the engagement with each of the drive wheel sections at opposing sides, as detailed below. By means of two guide rollers in the right-hand portion of the belt guiding means, the two belts are returned to the same level, more particularly up to their run to the roller in the left-hand top corner.

Figure 2:
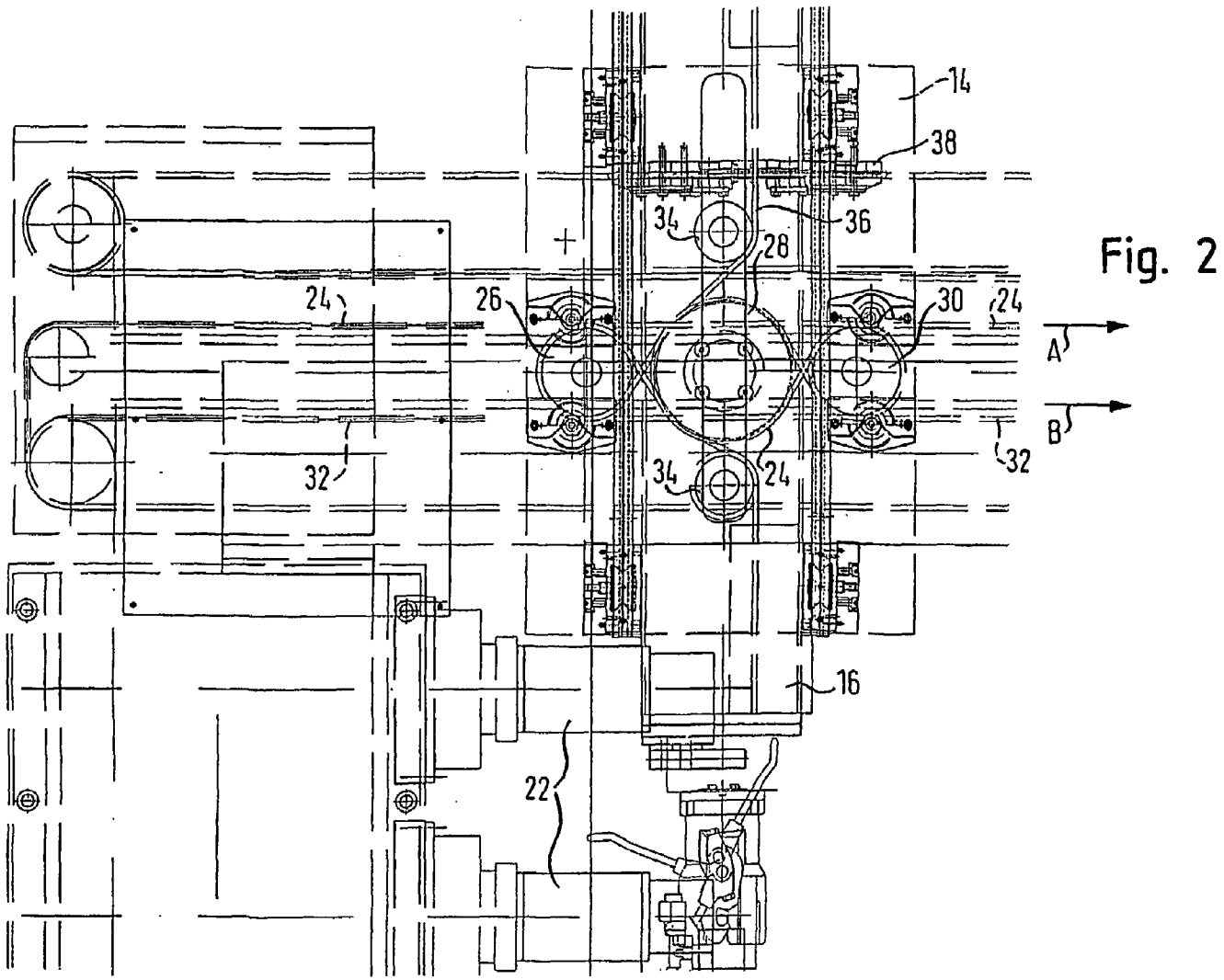
FIG. 2 is a side view of a section of the transfer device in accordance with the invention.

Referring now to FIG. 2 there is illustrated the slide 14 in section showing how the belts are guided in conjunction with the transfer device in accordance with the invention. A first belt 24 is guided via a first guide roller 26 and furthermore on the underside of a first drive wheel 28. At the right-hand side of the drive wheel 28 there is provided a further guide roller 30 so that the belt is reliably guided passed the underside of the first drive wheel 28 whilst reliably engaging the teeth of this wheel. To the right of the guide roller 30 is the first belt 24 which is at the same level as on the left of the first guide roller 26, namely at an "upper" level.

By contrast, a second belt 32 is provided at a "lower" level and is guided from the underside of a further guide roller, which is shown in FIG. 2 as located "downstream" of the guide roller 26 as shown, to the upper side of a second drive wheel which is likewise located "downstream" of the drive wheel 28 as shown. At this upper side the second belt 32 engages the second drive wheel by means of the teeth. A further guide roller on the right ensures that the second belt 32 is guided in turn by the upper side of the second drive wheel to the "lower" level. It is, of course, just as conceivable that each of the traction means is not guided by the corresponding drive wheel, as provided for in the preferred embodiment, but simply by engaging each drive wheel at opposite sides and being maintained engaged by suitable means at this location.

It is this opposing wrap of two drive wheels as described that achieves horizontal shifting of the slide 14. As regards the belts 24 and 32 it is to be noted that these are configured endless so that they can be driven in both directions by the drive motor 22 assigned in each case. When the belt 24 is driven such that at the location as indicated by the arrow A in FIG. 2 it is moved in the direction of the arrow A and the belt 32 is driven at the location as indicated by the arrow B in FIG. 2 is likewise moved in this direction, then the two drive wheels mounted on a common shaft or spindle will not move since the two movements of the belts 24, 32 cancel each other out in this respect. Instead, the slide 14 is moved as a whole in the direction of the arrows A, B, with each of the two drive motors 22 needing to furnish half of the drive moment which is a major advantage in dimensioning the two motors.

When, instead, the plunger 16 is to be moved in the vertical direction relative to the slide 14, the two belts are driven in different directions such that the two drive wheels rotate relative to the slide 14, and a third drive wheel provided on a common shaft with the other two drive wheels, is likewise rotated so that the plunger can be moved. When, for example, the "lower" belt 32 wrapped at the top is moved such that it is moved at the observed location in the direction of the arrow B whilst the upper belt 24 wrapped "at the bottom" is moved opposite to the direction of the arrow A, then the two drive wheels rotate in all clockwise. In this case, it is to be noted that it is particularly when employing a contour control 23 that each of the drive motors 22 can be driven so that the movement of the two belts is exactly opposing each other so that the slide 14 is stationary and only the shaft with the three drive wheels in the slide 14 rotates. As indicated in FIG. 2 a further cogged belt 36 is guided by two guide rollers 34 laterally via the third drive wheel (not shown) such that the cogged belt 36 is shifted by a rotation of the drive wheel and since the ends of the cogged belt are fixedly attached to the plunger 16 the plunger is moved correspondingly. More particularly, the plunger is moved upwards on clockwise rotation of the drive wheel, it being moved downwards when the drive wheel is driven counter-clockwise by the first belt 24 being moved in the direction of the arrow A and the second belt 32 opposite to the arrow B.

Regarding FIG. 2, it must be noted that a clincher of a belt is shown by which the two ends of the belt are joined together to make for an endless cogged belt. Since this clincher is relatively bulky and thus tends to oscillate especially on longish free sections, it is preferred that a guiding means is provided in which at least one section of the clincher is guided such that it has no movement in the vertical direction and thus prevents oscillations. It is furthermore to be noted that the movements of the two belts between the modes of operation as described above, shifting the slide, on the one hand, and moving the plunger, on the other, can be suitably combined. When the two belts are driven up to a point at which the plunger is to be lowered, in the direction of the arrow A and B respectively, and subsequently the two belts are driven opposingly to move the plunger, the gripper provided on the plunger is moved to a certain extent forming a right angle, namely firstly horizontally and after halting thereof, vertically. It is basically possible that the vertical movement can be commenced earlier, as long as no obstacle stands in the way with which the gripper could collide, so that the right angle as described is shorted or rounded to some extent. There is no problem in attaining this by suitably controlling the two motors in combining the movements needed for downwards motion with those for shifting section-wise.

Figure 3:
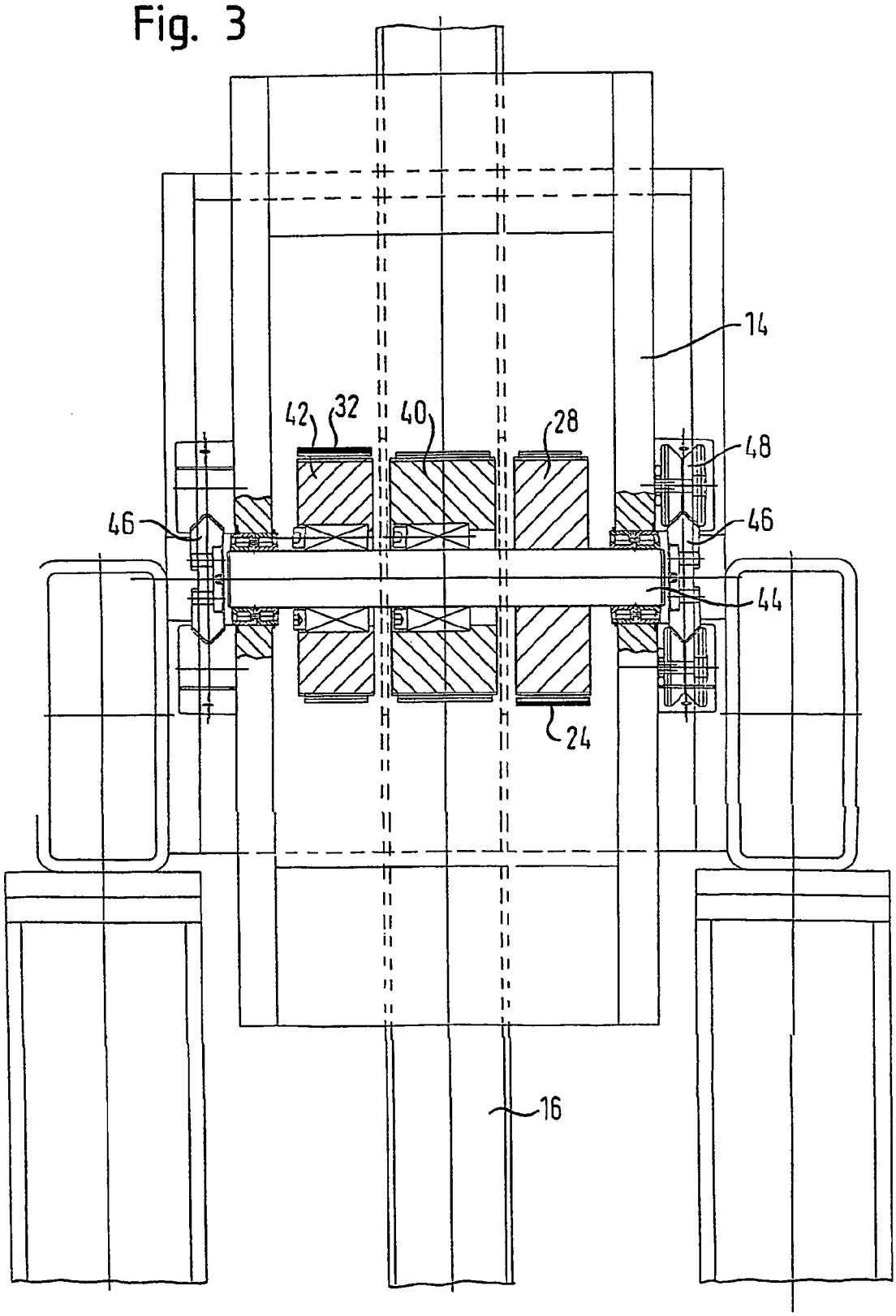
FIG. 3 is a side view of part of a transfer device in accordance with the invention in a first embodiment.

Referring now to FIG. 3 there is illustrated how the three drive wheels 28, 40 and 42 are fixedly attached to a common shaft 44 mounted rotatably in the slide 14. Evident on the sides of the slide 14 are the trapezoidal guiding means 46 at which the slide is guided in the embodiment as shown via suitably configured rollers 48. It is clearly evident from FIG. 3 that the three drive wheels 28, 40 and 42 are arranged juxtaposed so that the opposing guidance of the belts 24 and 32 as indicated in FIG. 3 results in no mutual effect. Provided between the two drive wheels 28, 42 in the embodiment as shown is the third drive wheel 40 which rotates with the shaft 44 which is then driven to rotate when the two drive wheels 28, 42 are actuated opposingly. On rotation, the third drive wheel 40 imparts a vertical movement to the plunger 16 via a belt 36 guided to some extent laterally (cf. FIG. 2).

Figure 4:
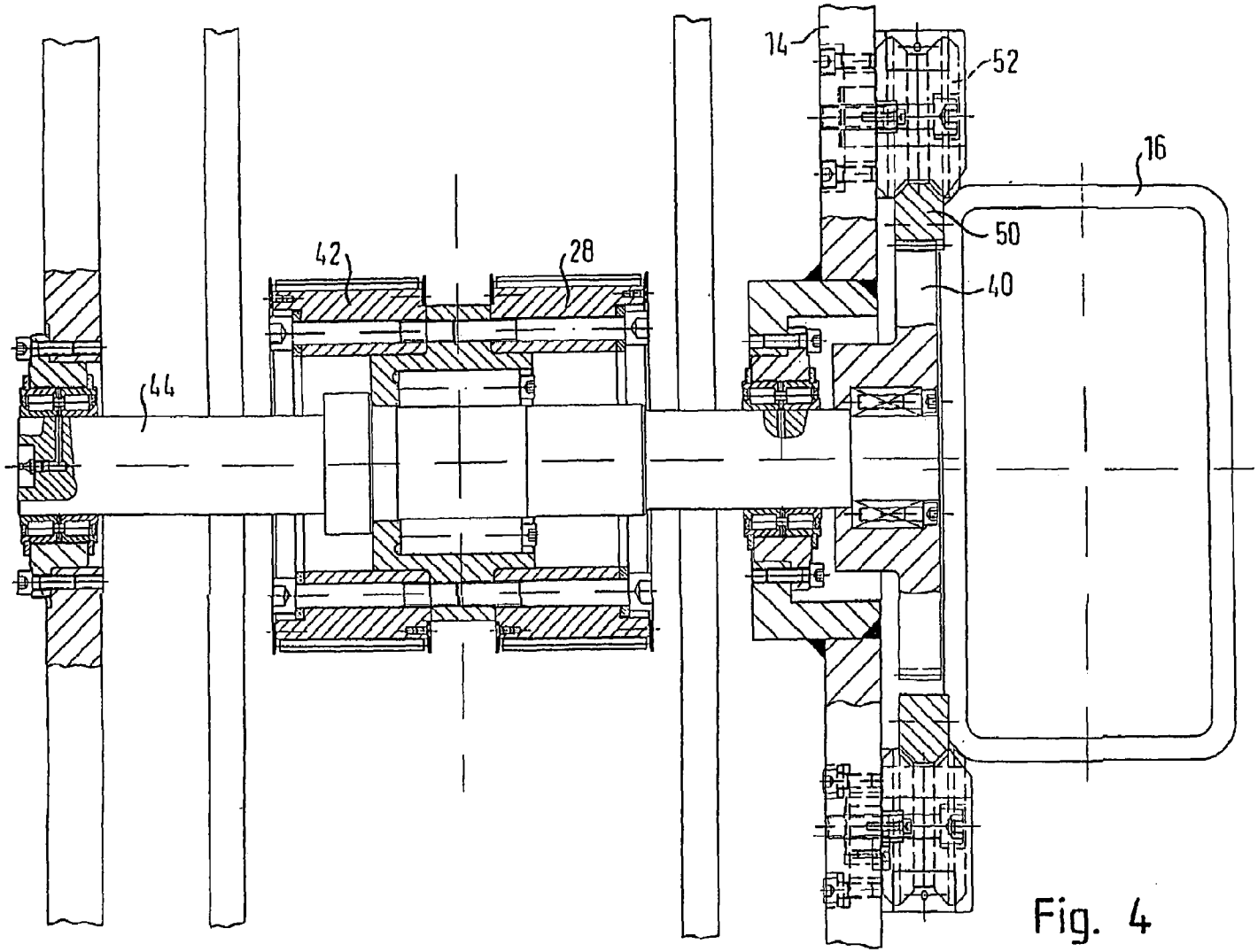
FIG. 4 is a plan view of part of the transfer device in accordance with the invention in a second embodiment.

Referring now to FIG. 4, there is illustrated an alternative embodiment for imparting the movement to the plunger 16. The two drive wheels 28, 42 are provided juxtaposed to a certain extent within the slide 14. The common shaft 44 rotatably mounted in the slide 14 protrudes from the slide where the third drive wheel 40 is provided. This third drive wheel 40 engages a gear rack 50 fixedly provided on the plunger 16 which is guided via suitable trapezoidal guiding means in rollers 52 provided rotatably on the plunger 16. In this embodiment too, the transfer device can be configured simply and compactly to achieve movement of the plunger 16 and more particularly the gripper provided thereon in two directions perpendicular to each other. It is furthermore to be noted that as evident from the illustration in FIG. 4 the plunger 16 is moved perpendicular to the plane of the drawing and the slide 14 is shifted on the associated guiding means as shown in FIG. 4 from top to bottom.

What is claimed is:

1. A transfer device comprising a guide, a slide moving on said guide, a plunger moving on said slide, first, second and third drive wheel sections provided to rotate in common and non-rotatably relative to each other on said slide, said first and second drive wheel sections engaging with first and second traction devices, respectively, on opposite sides of the first and second drive wheel sections and being driven by first and second motors fixedly located relative to said slide, and said third drive wheel section being connected to drive said plunger.

2. The transfer device as set forth in claim 1, wherein at least one of said drive wheel sections is a separate drive wheel.

3. The transfer device as set forth in claim 1, further comprising a contour control for said drive motor.

4. The transfer device as set forth in claim 1, wherein said traction devices each comprise cogged belts.

5. The transfer device as set forth in claim 1, wherein said third drive wheel section engages a cogged belt or gear rack.

* * * * *